US010093528B2

(12) United States Patent
Scott et al.

(10) Patent No.: US 10,093,528 B2
(45) Date of Patent: Oct. 9, 2018

(54) BOTTLE CAPPING CHUCKS

(71) Applicants: Michael P. Scott, Midland, MI (US); Larry D. Dotson, Midland, MI (US)

(72) Inventors: Michael P. Scott, Midland, MI (US); Larry D. Dotson, Midland, MI (US)

( * ) Notice: Subject to any disclaimer, the term of this patent is extended or adjusted under 35 U.S.C. 154(b) by 1376 days.

(21) Appl. No.: 13/865,256

(22) Filed: Apr. 18, 2013

(65) Prior Publication Data

US 2014/0311089 A1 Oct. 23, 2014

(51) Int. Cl.
*B67B 3/20* (2006.01)

(52) U.S. Cl.
CPC ..... *B67B 3/20* (2013.01); *B67B 3/2066* (2013.01)

(58) Field of Classification Search
CPC ..... B67B 3/2066; B67B 3/20
USPC ..... 53/331.5, 29, 334–337, 344–346, 349, 53/351, 353, 367, 356; 279/17, 71
See application file for complete search history.

(56) References Cited

U.S. PATENT DOCUMENTS 3,585,787 A * 6/1971 Podesta ..... B67B 3/14 53/344
4,222,214 A * 9/1980 Schultz ..... B67B 3/2073 279/33
4,222,215 A * 9/1980 Takano ..... B67B 3/2073 53/331.5
4,662,153 A * 5/1987 Wozniak ..... B67B 3/2073 53/317
4,922,684 A * 5/1990 Nelson ..... B65D 41/3409 53/314
5,473,855 A * 12/1995 Hidding ..... B65B 7/2835 53/314
6,508,046 B1 * 1/2003 Resterhouse ..... B67B 3/2066 53/331.5
7,181,892 B1 * 2/2007 Scott ..... B67B 3/2086 53/317
7,434,370 B1 * 10/2008 Scott ..... B65B 7/2835 192/56.4
7,770,358 B2 * 8/2010 Sink ..... B65B 7/2835 53/317
8,166,730 B2 * 5/2012 Schmatz ..... B67B 3/2066 53/317
8,220,225 B1 * 7/2012 Zemlin ..... B67B 3/2066 53/331.5
2006/0162286 A1 * 7/2006 Spether ..... B67B 3/2066 53/331.5
2009/0308025 A1 * 12/2009 Martin ..... B67B 3/2066 53/317
2010/0089004 A1 * 4/2010 Data ..... B67B 3/2033 53/317
2010/0205905 A1 * 8/2010 Schmatz ..... B67B 3/2066 53/317
2011/0225928 A1 * 9/2011 Naaber ..... B67B 3/2066 53/285

* cited by examiner

*Primary Examiner* — Hemant M Desai
*Assistant Examiner* — Mobeen Ahmed

(57) ABSTRACT

The capping industry has many variations in each cap that is placed on containers. It is very critical that a capping chuck have the ability to adapt quickly and easily to each and every cap that is available. The present invention uses the flexibility in its construction to grasp all variations to the caps without the need for expensive and time consuming shut downs. The present capping chuck meets these ever expanding changes within the industry.

1 Claim, 6 Drawing Sheets

BOTTLE CAPPING CHUCKS

BACKGROUND OF THE INVENTION

Capping chucks are not new to the art. The need for quickly interchangeable chucks is crucial to industries that use plastics in bottle processing. A major need is to adapt to the changing needs of the industry. Many prior art chucks exist in an attempt to meet the ever changing needs of the industry. The industry uses a wide variety of different size and shaped caps. Most have only aesthetic value. Such a response is U.S. Pat. No. 8,220,225 issued to Zemlin, on Jul. 17, 2012, entitled, "Capping Chuck Assembly".

The Zemlin patent uses a system that is dependent on ball bearings to facilitate movement of angled teeth to grip irregular size caps. The bottling industry is known to bottle soft drinks. The main drawback with the Zemlin chuck is that the sugar from the soft drinks accumulates on the Zemlin chuck impeding operation and the chuck has to be cleaned or replaced frequently.

THE INVENTION

The present invention is a capping chuck assembly for bottle capping machines. The assembly is comprised of a housing that has an operative end and a threaded end. This housing has a central opening therethrough that has a centered mid-point. The operative end comprises a hub that has a plurality of evenly spaced-apart notches therein. Each notch has resident therein an independently radially movable chuck segment.

The chuck segment has a front surface that has a plurality of vertical pins positioned thereon for gripping a bottle cap. The hub has a horizontally grooved outside surface 40. Each chuck segment has a horizontally grooved back surface aligning with the grooves in the hub and configured for receiving an O-ring therein. Each chuck segment has a first end surface that is biased to allow the chuck segment to be move radially away from the centered mid-point of the central opening.

Each chuck segment has a second end surface that is biased to allow the chuck segment to be retained in a respective notch. A common rubber O-ring is located in the hub grooves and the chuck segment grooves.

DETAILED DESCRIPTION OF THE DRAWINGS

Figure 1:
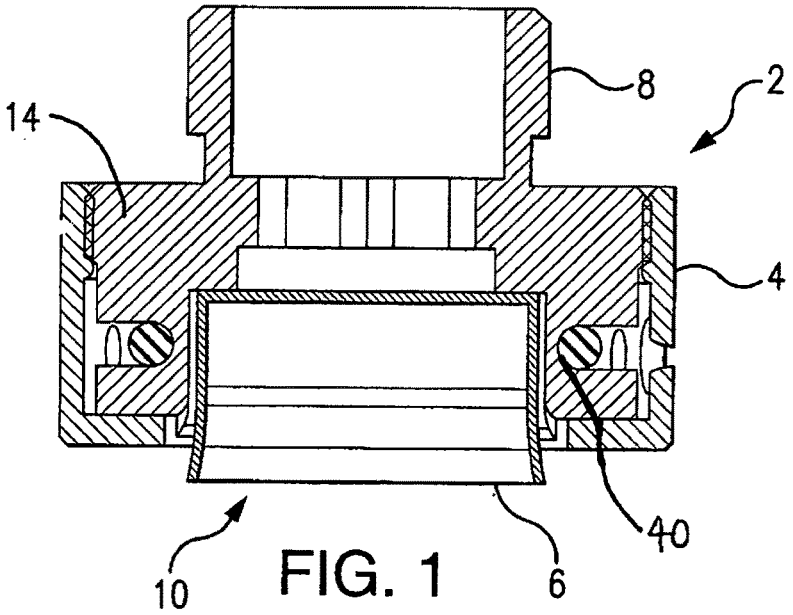
FIG. 1 is a cross sectional view of the capping chuck assembly taken through line B-B of FIG. 2.

FIG. 1 is a sectional view of the capping chuck assembly 2. The threaded end 8 is near the top and is capable of quickly attaching or detaching onto a capping machine. The housing 4 contains within it the operative end 6 (capping end). The operative end 6 is also where the hub 14 can be observed. Also shown is the central opening 10 that passes through the entire length of the capping chuck assembly 2.

Figure 2:
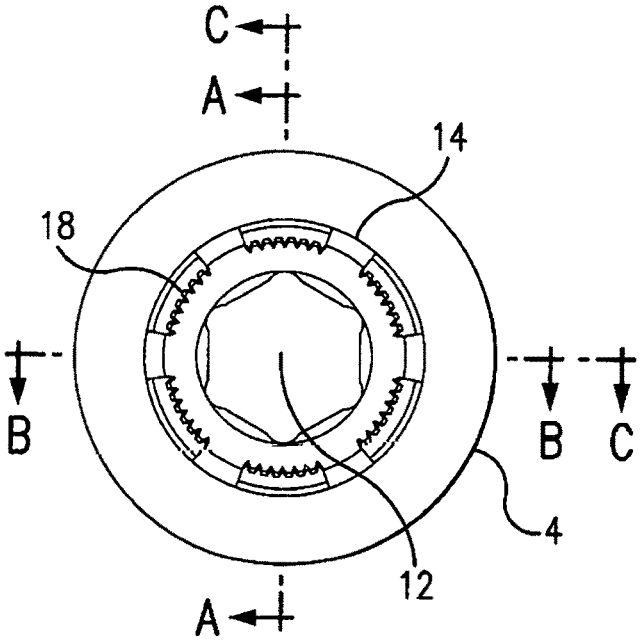
FIG. 2 is a full view of the capping end of the capping chuck.

FIG. 2 shows the operations end 6. It is shown in this view where the center midpoint 12 resides. The housing 4 contains the hub 14 and the independently, radially movable, chuck segments 37 and teeth 18.

Figure 3:
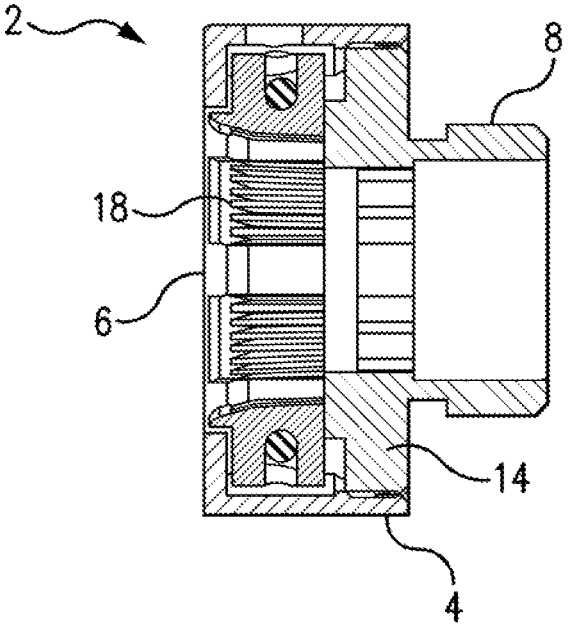
FIG. 3 is a cross sectional view of the capping chuck assembly taken through line A-A of FIG. 2.

FIG. 3 shows a sectional view of line A-A of the capping chuck assembly 2 of FIG. 2. The hub 14 shows the threaded end 8 and the operations end 6. Also shown within the housing 4 are the hub 14 and the teeth 18.

Figure 4:
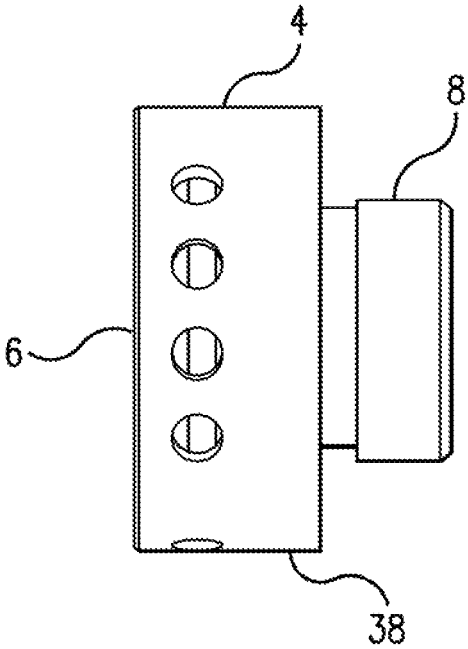
FIG. 4 is a full view of the capping chuck assembly from the side.

FIG. 4 shows the capping chuck assembly 2 from the side. The housing 4 has an outside surface 38.

Figure 5:
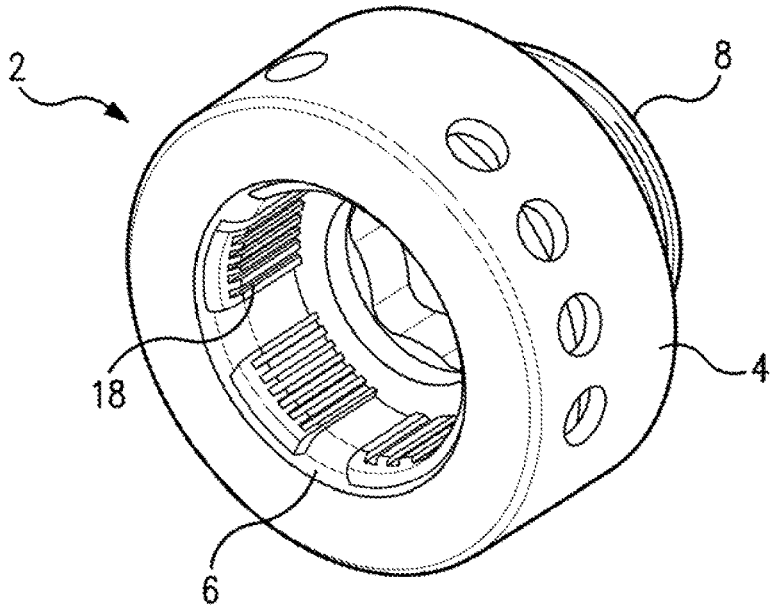
FIG. 5 is a view in perspective of the capping chuck assembly showing the bottom opening or the operative end 6.

FIG. 5 shows the capping chuck assembly 2. This Figure shows the housing 4, the threaded end 8 and the operative end 6. Inside of the operative end 6 are the teeth 18. The capping chuck assembly 2 attaches to the capping machine at the threaded end 8. The operative end 6 is where the caps are screwed onto the bottles. The cap inserts into the operative end 6, the teeth 18 grab the cap and tighten it to the bottle. The teeth 18 are supported in the housing 4 by the hub 14 and an O ring (not shown in this Figure).

It has been discovered that the flexibility of the teeth 18 within the housing 4 allow the capping chuck assembly 2 to accommodate any varying shape and size caps. This is a huge utility over all prior art cappers, in that, cappers have to be changed to fit different caps. The industry uses a variety of sized and shaped caps mostly for aesthetic purposes. Each time there is a change in the type of cap used the capper has to be changed out. This slows or stops production, wasting money. The bearing-less design allows for longer use with less fouling and reduction in loss of production time, saving time and money.

Figure 6:
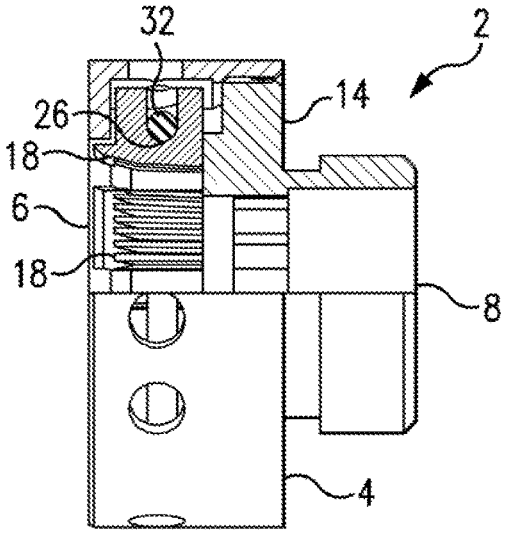
FIG. 6 is a partial sectional view of the capping chuck taken through line C-C of FIG. 2.

FIG. 6 is a partial sectional view of the capping chuck assembly 2. This Figure shows the relationship between the teeth 18, hub 14 and the O ring 32. The O ring 32 holds the teeth 18 and hub 14 in place, but allows them to expand to accept or accommodate the varying sizes and shapes of the caps. Also shown is the groove 26 in the hub 14 for the O ring for flexibly retaining the teeth 18. It also shows the relationship between the housing 4, the threaded end 8 and the operative end 6.

Figure 7:
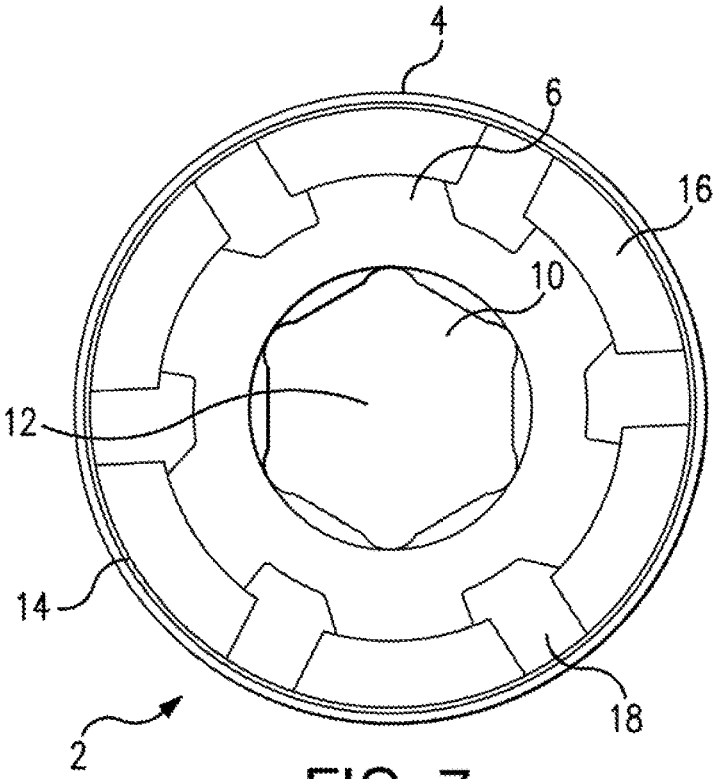
FIG. 7 is a full bottom view of the capping chuck.

FIG. 7 shows the end of the capping chuck 2. This view shows the housing 4 attachment area in relationship to the hub 14. It shows the relationship of the evenly spaced notches 16 in cooperation with the hub 14 and teeth 18 of the operative end 6. Also it is clear that the central opening 10 has a central midpoint 12.

Figure 8:
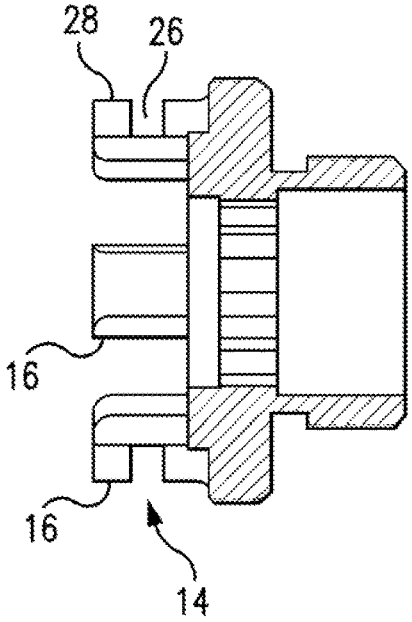
FIG. 8 is a full view of FIG. 3 without the teeth.

FIG. 8 shows the capping chuck assembly 2 without teeth 18. Here the hub 14 shows the evenly spaced notches 16 and the groove 26 that accommodate the O ring 32. Also shown here is the back surface 28 of each evenly spaced notch 16.

Figure 9A:
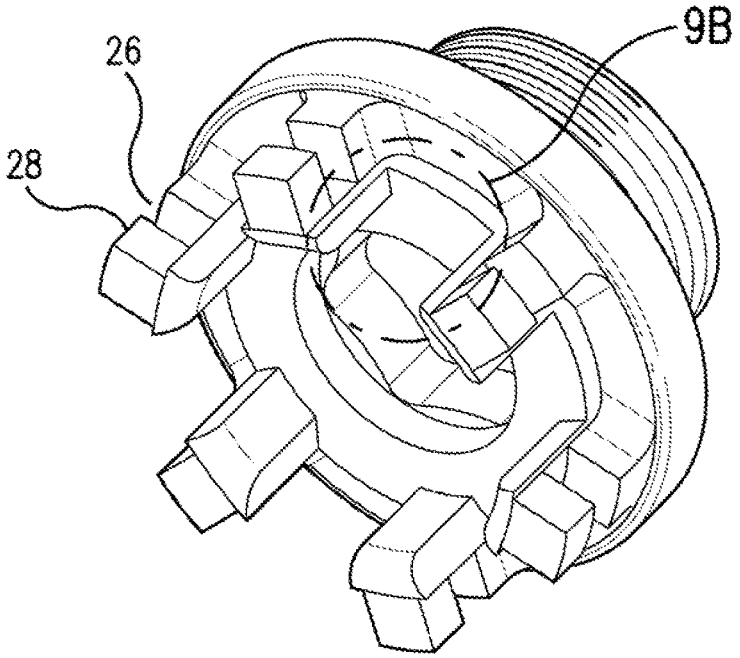
FIG. 9A is a view in perspective of the capping chuck without teeth showing the bottom opening.

FIG. 9A shows the capping chuck assembly 2 without teeth from the side. Shown is the back surface 28 of the evenly spaced notches 16 and the groove 26 of the evenly spaced notches that together form the hub 14.

Figure 9B:
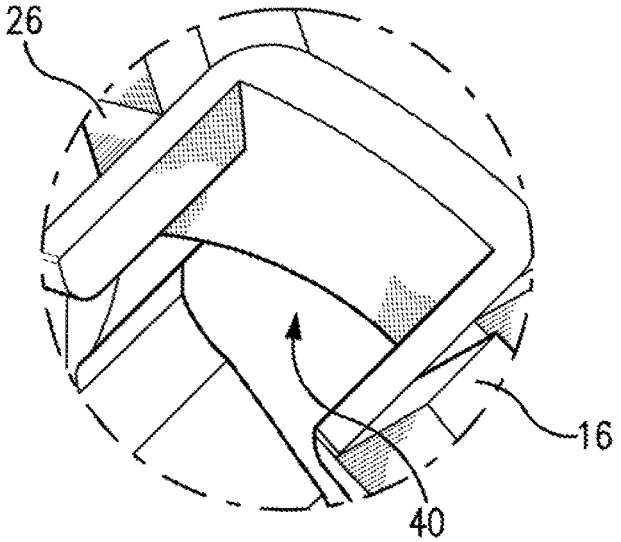
FIG. 9B is a full view of an enlarged portion of a segment of FIG. 9A to showing the absences of teeth.

FIG. 9B shows the capping chuck assembly 2 in an expanded view without a tooth 18. This is the position 40 where each tooth 18 is flexibly placed within the hub 14 and between the evenly spaced notches 16 and retained by the O ring 32.

Figure 10:
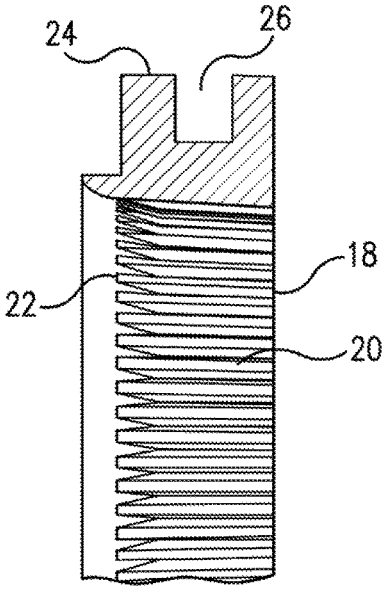
FIG. 10 is a full view of a segment of a chuck showing enlarged teeth.

FIG. 10 shows the toothed edge 22 of a tooth 18. Also shown is the front surface 20 of tooth 18 and the outside surface 24 of the tooth 18. The groove 26 for the O ring 32 is also shown.

Figure 11:
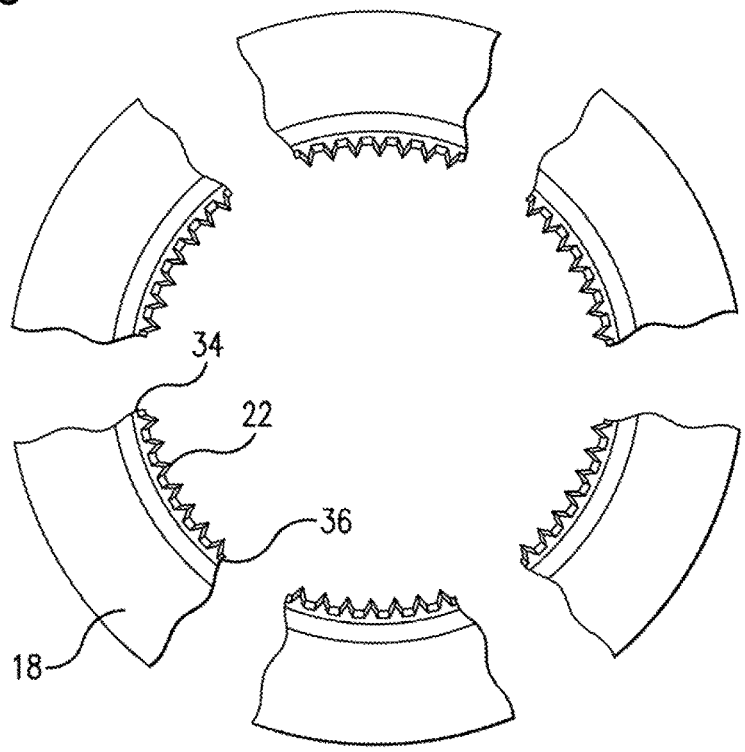
FIG. 11 is an expanded full bottom view of the various tooth segments.

FIG. 11 the chuck segments 37. Each chuck segment 37 has vertical pins 22 that combine to form teeth 18. Each chuck segment 37 has a first end surface 34 and an end surface 36. This Figure shows the angle of each vertical pin 22 that allows the chuck segments 37 to make contact with the cap and grip it during the capping process thus driving the cap in the desired direction and tightening the cap onto the bottle.

What is claimed is:

1. A capping chuck assembly, said assembly comprising:

a. a housing having an operative end and a threaded end, said housing having a central opening therethrough having a centered mid-point;

b. said operative end comprising a hub, having a plurality of evenly spaced-apart notches therein, each said notch having resident therein an independently, radially movable chuck segment, each said chuck segment having a front surface having a plurality of vertical pins positioned thereon for gripping a bottle cap;

c. said hub having a horizontally grooved outside surface;

d. each said chuck segment having a horizontally grooved back surface aligning with said groove in said hub and configured for receiving an O-ring therein;

e. each said chuck segment having a first end surface that is biased to allow each said chuck segment to move radially away from said centered mid-point of said central opening;

f. each said chuck segment having a second end surface that is biased to allow each said chuck segment to be retained in a respective notch;

g. said O-ring located in said hub groove and each horizontally grooved back surface of each chuck segment.

* * * * *